US005876913A

United States Patent [19]

Dickerson et al.

[11] Patent Number: 5,876,913

[45] Date of Patent: Mar. 2, 1999

[54] DUAL-COATED RADIOGRAPHIC ELEMENTS WITH LIMITED HYDROPHILIC COLLOID COATING COVERAGES

[75] Inventors: Robert E. Dickerson, Hamlin; Anthony Adin, Rochester; Marcia K. Hansen, Fairport, all of N.Y.

[73] Assignee: Eastman Kodak Company, Rochester, N.Y.

[21] Appl. No.: 864,124

[22] Filed: May 28, 1997

[51] Int. Cl.[6] ..... G03C 1/035; G03C 1/047; G03C 5/16

[52] U.S. Cl. ..... 430/567; 430/502; 430/508; 430/509; 430/966; 430/569; 430/438

[58] Field of Search ..... 430/502, 508, 430/509, 966, 567, 569, 438

[56] References Cited

U.S. PATENT DOCUMENTS

| | | | |
|---|---|---|---|
| 4,177,071 | 12/1979 | De Brabandere et al. | 430/494 |
| 4,414,304 | 11/1983 | Dickerson | 430/353 |
| 4,647,528 | 3/1987 | Yamada et al. | 430/567 |
| 5,187,050 | 2/1993 | Yamada et al. | 430/399 |
| 5,292,627 | 3/1994 | Hershey et al. | 430/356 |
| 5,292,631 | 3/1994 | Hershey et al. | 430/567 |
| 5,576,156 | 11/1996 | Dickerson | 430/502 |
| 5,738,981 | 4/1998 | Dickerson et al. | 430/509 |

FOREIGN PATENT DOCUMENTS

| | | | |
|---|---|---|---|
| 3433893 A1 | 9/1984 | Germany | G03C 1/30 |
| 6-266068 | 9/1994 | Japan | G03C 5/26 |
| 7-104411 | 4/1995 | Japan | G03C 1/053 |

*Primary Examiner*—Mark F. Huff
*Attorney, Agent, or Firm*—Carl O. Thomas

[57] ABSTRACT

Dual-coated radiographic elements are disclosed employing thin tabular grain emulsions that exhibit increased covering power and colder image tones by limiting hydrophilic colloid coating coverages in the thin tabular grain emulsion layers to less than 15 mg/dm$^2$.

6 Claims, No Drawings

DUAL-COATED RADIOGRAPHIC ELEMENTS WITH LIMITED HYDROPHILIC COLLOID COATING COVERAGES

FIELD OF THE INVENTION

The invention relates to radiography. More specifically, the invention relates to silver halide emulsion layer containing radiographic elements.

DEFINITION OF TERMS

In referring to grains and emulsions containing two or more halides, the halides are named in order of ascending concentrations.

The term "high bromide" in referring to grains and emulsions indicates that bromide is present in a concentration of greater than 50 mole percent, based on silver.

The term "equivalent circular diameter" or "ECD" is employed to indicate the diameter of a circle having the same projected area as a silver halide grain.

The term "aspect ratio" designates the ratio of grain ECD to grain thickness (t).

The term "tabular grain" indicates a grain having two parallel crystal faces which are clearly larger than any remaining crystal faces and an aspect ratio of at least 2.

The term "tabular grain emulsion" refers to an emulsion in which tabular grains account for greater than 50 percent of total grain projected area.

The term "thin" in referring to tabular grains and tabular grain emulsions indicates a mean tabular grain thickness of less than 0.2 $\mu$m.

The term "ultrathin" in referring to tabular grains and tabular grain emulsions indicates a mean tabular grain thickness of less than 0.07 $\mu$m.

The term "coefficient of variation" or "COD" is defined as the standard deviation ($\sigma$) of grain ECD divided by mean grain ECD.

The term "average contrast" or "$\gamma$" is defined as the slope of a line drawn between characteristic curve points of 0.25 and 2.0 above minimum density ($D_{min}$).

Covering power is defined as 100 times the ratio of maximum density to coated silver expressed in milligrams per square decimeter (mg/dm$^2$).

The terms "front" and "back" in referring to radiographic imaging are used to designate locations nearer to and farther from, respectively, the source of X-radiation than the support of the radiographic element.

The term "dual-coated" is used to indicate a radiographic element having emulsion layers coated on both the front and back sides of its support.

The terms "colder" and "wanner" in referring to image tone are used to mean CIELAB b* values measured at a density of 1.0 (dual-coated) above minimum density that are more negative or positive, respectively. The b* measurement technique is described by Billmeyer and Saltzman, *Principles of Color Technology*, 2nd. Ed., Wiley, New York, 1981, at Chapter 3. The b* values describe the yellowness vs. blueness of an image with more positive values indicating a tendency toward greater yellowness.

*Research Disclosure* is published by Kenneth Mason Publications, Ltd., Dudley House, 12 North St., Emsworth, Hampshire P0107DQ, England.

BACKGROUND

In medical diagnostic radiography the object is to obtain a viewable silver image from which a medical diagnosis can be made while exposing the patient to a minimal dose of X-radiation. Patient exposure to X-radiation is minimized by employing a dual-coated radiographic element in combination with front and back fluorescent intensifying screens. A portion of the X-radiation transmitted through the patient's anatomy is absorbed by each of the front and back intensifying screens. Each screen emits light in response to X-radiation exposure, and the emitted light from the front and back screens imagewise exposes the front and back emulsion layers of the dual-coated radiographic element. With this arrangement, patient exposure to X-radiation can be reduced to about 5 percent of the X-radiation exposure level that would be required for comparable imaging using a single emulsion layer and no intensifying screen.

Unlike photographic images, which arc taken in small formats and then enlarged for viewing, radiographic images are normally viewed without enlargement. Thus, very large formats by photographic standards are required. Further, unlike color photography, wherein silver is reclaimed in processing, the silver in radiographic elements is often not reclaimed for years, since the images are required to be available to substantiate diagnoses. Further, usually a number of images are obtained when subject matter of pathological interest is observed. Thus, there has been in medical diagnostic imaging a long standing need to minimize to the extent feasible the silver contained in the elements.

Although higher covering power had been previously attributed to tabular grain emulsions, Dickerson U.S. Pat. No. 4,414,304 recognized that tabular grain emulsions having average tabular grain thicknesses of less than 0.2 $\mu$m are capable of providing higher covering power than thicker tabular grain emulsions. With this discovery it would seem logical to incorporate the thinnest possible tabular grains in radiographic elements, but this has not occurred in practice. For example, ultrathin tabular grain emulsions, those with mean tabular grain thicknesses of less than 0.07 $\mu$m, are preferred for many photographic applications, but such emulsions are rarely, if ever, employed in radiographic elements.

What has stifled silver coating coverage reductions by employing tabular grains of minimum mean thicknesses is the observation that image tone becomes increasingly warm as mean tabular grain thickness is decreased. Radiologists strongly prefer images that have a "cold" (e.g., blue-black) appearance as compared to those with a "warm" (e.g., brown-black) appearance. Typically radiographic elements employ blue-tinted supports in combination with silver halide emulsions selected to provide overall colder image tones.

Attempts to achieve both higher covering power and colder image tones in thin tabular grain emulsions have been diligently pursued without success. For example, Hershey et al U.S. Pat. No. 5,292,631 discloses alkylthio-substituted azoles to increase the covering power of high bromide tabular grain emulsions. However, alkylthio-substituted azoles are reported by Hershey et al U.S. Pat. No. 5,292,627 to produce colder image tones in only nontabular grain emulsions with mean ECD's of less than 0.3 $\mu$m.

SUMMARY OF THE INVENTION

In one aspect, this invention is directed to a radiographic element comprised of a blue tinted film support having first and second major surfaces and, coated on each of the major surfaces of the support, at least one tabular grain emulsion layer containing a hydrophilic colloid vehicle and radiation-sensitive silver halide grains containing greater than 50 mole percent bromide and less than 3 mole percent iodide, based on silver, the weight ratio of silver forming the silver halide grains to the hydrophilic colloid being less than 1:1, wherein, within the tabular grain emulsion layer, the tabular grains have a mean thickness of less than 0.2 μm and the hydrophilic colloid is coated at a coverage of less than 15 mg/dm$^2$.

It has been discovered quite unexpectedly that both higher covering power and colder image tones are produced when hydrophilic colloid coverages in thin tabular grain emulsion layers are employed at these reduced hydrophilic colloid coating coverages.

Additional advantages and preferred features are discussed and demonstrated in the description that follows.

PREFERRED EMBODIMENTS

An exposure assembly, including a dual-coated radiographic element satisfying the requirements of the invention, is schematically illustrated as follows:

| Assembly I |
|---|
| Front Screen Support (FSS) |
| Front Luminescent Layer (FLL) |
| Front Hydrophilic Colloid Layer Unit (FHCLU) |
| Blue Tinted Transparent |
| Film Support (BTTFS) |
| Back Hydrophilic Colloid Layer Unit (BHCLU) |
| Back Luminescent Layer (BLL) |
| Back Screen Support (BSS) |

A dual-coated radiographic element satisfying the requirements of the invention is formed by FHCLU, BTTFS and BHCLU. Prior to imagewise exposure to X-radiation, the dual-coated radiographic element, a front intensifying screen, formed by FSS and FLL, and a back intensifying screen, formed by BSS and BLL, are mounted in the orientation shown in a cassette (not shown), but with the screens and film in direct contact.

X-radiation in an image pattern passes through FSS and is, in part, absorbed in FLL. The front luminescent layer re-emits a portion of the absorbed X-radiation energy in the form of a light image, which exposes one or more silver halide emulsion layers contained in FHCLU. X-radiation that is not absorbed by the front screen passes through the dual-coated radiographic element with minimal absorption to reach BLL in the back screen. BLL absorbs a substantial portion of the X-radiation received and re-emits a portion of the X-radiation energy in the form of a light image that exposes one or more silver halide emulsion layers contained in BHCLU.

In the simplest possible construction of the radiographic elements of this invention each of FHCLU and BHCLU consists of a single tabular grain emulsion containing:

(a) radiation-sensitive high bromide tabular grains having a mean ECD of less than 0.2 μm;

(b) a weight ratio of silver forming the silver halide grains to hydrophilic colloid of less than 1:1; and (c) the hydrophilic colloid exhibiting a coating coverage of less than 30 mg/dm$^2$.

(a)

The radiation-sensitive high bromide grains contain greater than 50 mole percent bromide, based on silver, and less than 3 mole iodide, based on silver. Any halide other than bromide and iodide can be chloride and can account for up to (but not including) 50 mole percent of total halide, based on silver. Preferably chloride, if present, is limited to less than 10 mole percent, based on silver. Preferred silver halide grain compositions are silver bromide and silver iodobromide, with silver chlorobromide, silver iodochlorobromide and silver chloroiodobromide also being contemplated.

Tabular grains account for greater than 50 percent of total grain projected area. Preferably the tabular grains account for at least 70 percent of total grain projected area and, to achieve the highest contemplated levels of performance, at least 90 percent of total grain projected area.

The grains have a mean ECD that seldom exceeds 5 μm. The emulsions in the radiographic elements of this invention in all instances exhibit a mean ECD of greater than 0.3 μm and preferably greater than 0.5 μm.

The radiation-sensitivity of the high bromide grains is increased by conventional chemical sensitization. Conventional chemical sensitizers are illustrated in *Research Disclosure*, Vol. 389, Sept. 1996, Item 38957, Section IV. Chemical sensitization. Typically at least one and usually both of sulfur and gold sensitizers are employed.

Illustrations of precipitation and sensitization of high bromide tabular grain emulsions that can be applied to the practice of the invention are illustrated by the following, hereinafter referred to as the HBTG listing:

Dickerson U.S. Pat. No. 4,414,310;
Abbott et al U.S. Pat. No. 4,425,425;
Abbott et al U.S. Pat. No. 4,425,426;
Kofron et al U.S. Pat. No. 4,439,520;
Wilgus et al U.S. Pat. No. 4,434,226;
Maskasky U.S. Pat. No. 4,435,501;
Maskasky U.S. Pat. No. 4,713,320;
Dickerson et al U.S. Pat. No. 4,803,150;
Dickerson et al U.S. Pat. No. 4,900,355;
Dickerson et al U.S. Pat. No. 4,994,355;
Dickerson et al U.S. Pat. No. 4,997,750;
Bunch et al U.S. Pat. No. 5,021,327;
Tsaur et al U.S. Pat. No. 5,147,771;
Tsaur et al U.S. Pat. No. 5,147,772;
Tsaur et al U.S. Pat. No. 5,147,773;
Tsaur et al U.S. Pat. No. 5,171,659;
Dickerson et al U.S. Pat. No. 5,252,442;
Dickerson U.S. Pat. No. 5,391,469;
Dickerson et al U.S. Pat. No. 5,399,470;
Maskasky U.S. Pat. No. 5,411,853;
Maskasky U.S. Pat. No. 5,418,125;
Daubendiek et al U.S. Pat. No. 5,494,789;
Olm et al U.S. Pat. No. 5,503,970;
Wen et al U.S. Pat. No. 5,536,632;
King et al U.S. Pat. No. 5,518,872;
Fenton et al U.S. Pat. No. 5,567,580;
Daubendiek et al U.S. Pat. No. 5,573,902;
Dickerson U.S. Pat. No. 5,576,156;
Daubendiek et al U.S. Pat. No. 5,576,168;
Olm et al U.S. Pat. No. 5,576,171;
Deaton et al U.S. Pat. No. 5,582,965.

As coated in these patents the emulsion layers contain higher hydrophilic colloid coating coverages than required by the present invention. However, as is conventional practice, grain precipitation occurs in the presence of low levels of peptizer that are fully compatible with the practice of the invention. The present invention differs from the teachings of these patents after precipitation and sensitization has been completed.

When the intensifying screens emit in the blue and near ultraviolet regions of the spectrum, the native sensitivity of silver bromide (and silver iodide, if present) to blue and near ultraviolet light can be relied upon for imaging response. When the intensifying screens emit light of longer wavelengths, a spectral sensitizing dye is absorbed to the surface of the grains to facilitate light absorption. These dyes also increase imaging speed even when the intensifying screens emit in a spectral region of native radiation-sensitivity. Illustrations of spectral sensitizing dyes are provided in *Research Disclosure*, Item 38957, Section V.A. Sensitizing dyes.

Kofron et al U.S. Pat. No. 4,439,520, here incorporated by reference, was the first to recognize imaging advantages of substantially optimally chemically and spectrally sensitized tabular grain emulsions. Kofron et al is particularly noted to contain a listing of dyes that sensitize to the blue region of the spectrum.

(b)

The high bromide grains are dispersed in hydrophilic colloid, which serves as a vehicle for each emulsion layer. To protect the emulsion layers from wet pressure sensitivity, the weight ratio of silver forming the silver halide grains to the hydrophilic colloid is less than 1:1. Wet pressure sensitivity is observed as "tire tracks" on the film. That is, as the wet film is being roller transported through a rapid access processor, areas in which one or more transport rollers have contacted the film are observed as areas of elevated density. When the emulsion layer contains on a weight basis at least as much hydrophilic colloid as silver, these areas of elevated density are avoided in a well-adjusted processor.

The minimum silver coating coverage is a function of the lowest maximum density that can be accepted for a particular radiographic application and the covering power of the emulsion. Except for unusual applications, silver coating coverages of at least 5 mg/dm$^2$, more typically 7 mg/dm$^2$, are contemplated.

(c)

The total hydrophilic colloid forming each emulsion layer is maintained at a coating coverage of less than 15 mg/dm$^2$. Except for unusual applications the hydrophilic colloid coverage is at least 5 mg/dm$^2$ and, most preferably, at least 10 mg/dm$^2$. As hydrophilic coating coverages are reduced, it has been observed quite unexpectedly that both silver covering power and image tone are improved. Whereas intensive investigations in the art have established that increases in covering power achieved by employing thinner tabular grains are accompanied by undesirably wanner image tones, it has been observed that very low hydrophilic colloid coating coverages have the beneficial effects of both increasing covering power and producing increasingly cold image tones. Quantitatively, the colder image tones are observed as shifts toward less positive or more negative b* values.

The hydrophilic colloid in each emulsion layer includes both the peptizer introduced to suspend silver halide grains during their precipitation and the binder added in the later stages of precipitation and subsequently to facilitate coating. Often the same materials are employed as both peptizer and binder; hence, the vehicle can, in its simplest form can consist of a single hydrophilic colloid. As described below, combinations of hydrophilic colloids can be employed to achieve optimum performance.

Suitable hydrophilic materials include both naturally occurring substances, such as proteins, protein derivatives, cellulose derivatives—e.g., cellulose esters, gelatin—e.g., alkali-treated gelatin (cattle bone or hide gelatin) or acid-treated gelatin (pigskin gelatin), gelatin derivatives—e.g., acetylated gelatin, phthalated gelatin and the like, polysaccharides such as dextran and cationic starch, gum arabic, zein, casein, pectin, collagen derivatives, collodion, agar-agar, arrowroot, albumin and the like as described in Yutzy et al U.S. Pat. Nos. 2,614,928 and '929, Lowe et al U.S. Pat. Nos. 2,691,582, 2,614,930, '931, 2,327,808 and 2,448,534, Gates et al U.S. Pat. Nos. 2,787,545 and 2,956,880, Himmelmann et al U.S. Pat. No. 3,061,436, Farrell et al U.S. Pat. No. 2,816,027, Ryan U.S. Pat. Nos. 3,132,945, 3,138,461 and 3,186,846, Dersch et al U.K. Patent 1,167,159 and U.S. Pat. Nos. 2,960,405 and 3,436,220, Geary U.S. Pat. No. 3,486,896, Gazzard U.K. Patent 793,549, Gates et al U.S. Pat. Nos. 2,992,213, 3,157,506, 3,184,312 and 3,539,353, Miller et al U.S. Pat. No. 3,227,571, Boyer et al U.S. Pat. No. 3,532,502, Malan U.S. Pat. No. 3,551,151, Lohmer et al U.S. Pat. No. 4,018,609, Luciani et al U.K. Patent 1,186,790, U.K. Patent 1,489,080 and Hori et al Belgian Patent 856,631, U.K. Patent 1,490,644, U.K. Patent 1,483,551, Arase et al U.K. Patent 1,459,906, Salo U.S. Pat. Nos. 2,110,491 and 2,311,086, Fallesen U.S. Pat. No. 2,343,650, Yutzy U.S. Patent 2,322,085, Lowe U.S. Pat. No. 2,563,791, Talbot et al U.S. Pat. No. 2,725,293, Hilborn U.S. Pat. No. 2,748,022, DePauw et al U.S. Pat. No. 2,956,883, Ritchie U.K. Patent 2,095, DeStubner U.S. Pat. No. 1,752,069, Sheppard et al U.S. Pat. No. 2,127,573, Lierg U.S. Pat. No. 2,256,720, Gaspar U.S. Pat. No. 2,361,936, Farmer U.K. Patent 15,727, Stevens U.K. Patent 1,062,116, Yamamoto et al U.S. Pat. No. 3,923,517 Maskasky U.S. Pat. No. 5,284,744, Bagchi et al U.S. Pat. Nos. 5,318,889 and 5,378,598, and Wrathall et al U.S. Pat. No. 5,412,075.

Relatively recent teachings of gelatin and hydrophilic colloid peptizer modifications and selections are illustrated by Moll et al U.S. Pat. Nos. 4,990,440 and 4,992,362 and EPO 0 285 994, Koepff et al U.S. Pat. No. 4,992,100, Tanji et al U.S. Pat. No. 5,024,932, Schulz U.S. Pat. No. 5,045,445, Dumas et al U.S. Pat. No. 5,087,694, Nasrallah et al U.S. Pat. No. 5,210,182, Specht et al U.S. Pat. No. 5,219,992, Nishibori U.S. Pat. No. 5,225,536, U.S. Pat. No. 5,244,784, Weatherill U.S. Pat. No. 5,391,477, Lewis et al U.S. Pat. No. 5,441,865, Kok et al U.S. Patent 5,439,791, Tavernier EPO 0 532 094, Kadowaki et al EPO 0 551 994, Michiels et al EPO 0 628 860, Sommerfeld et al East German DD 285 255, Kuhrt et al East Gennan DD 299 608, Wetzel et al East German DD 289 770 and Farkas U.K. Patent 2,231,968.

Where the peptizer is gelatin or a gelatin derivative it can be treated prior to or during emulsion precipitation with a methionine oxidizing agent.

Examples of methionine oxidizing agents include NaOCl, chloramine, potassium monopersulfate, hydrogen peroxide and peroxide releasing compounds, ozone, thiosulfates and alkylating agents. Specific illustrations are provided by Maskasky U.S. Pat. Nos. 4,713,320 and 4,713,323, King et al U.S. Pat. No. 4,942,120, Takada et al EPO 0 434 012 and Okumura et al EPO 0 553 622.

Maskasky U.S. Pat. Nos. 5,604,085 and 5,620,840, the disclosures of which is here incorporated by reference, disclose the precipitation of high bromide tabular grain emulsions in the presence of cationic starch. Maskasky U.S. Pat. No. 5,667,915, here incorporated by reference, titled HIGH BROMIDE ULTRATHIN TABULAR GRAIN EMULSIONS IMPROVED BY PEPTIZER MODIFICATION, commonly assigned, discloses the use of oxidized cationic starch as a peptizer. Maskasky U.S. Pat.

No. 5,629,142, here incorporated by reference, titled RADIOGRAPHIC ELEMENTS CONTAINING TABULAR GRAIN EMULSIONS WITH IMPROVED PHOTOGRAPHIC VEHICLES, discloses radiographic elements containing cationic starch peptizers, including those modified with oxidizing agents, in high bromide tabular grain emulsions in radiographic elements. All of these forms of cationic starch are contemplated for use as peptizers in the emulsions layers of the radiographic elements of the invention. In addition these cationic starches can be used to supplement gelatin and gelatin derivatives used as vehicles in the emulsions layers. When cationic starch (including oxidized cationic starch) is employed as a vehicle, it is preferred to include at least 45 percent by weight of gelatin or a gelatin derivative in combination.

Each of the emulsion layers can also contain in combination with the hydrophilic colloids named above materials capable of acting as vehicles or vehicle extenders (e.g., in the form of latices), synthetic polymeric peptizers, carriers and/or binders such as poly(vinyl lactams), acrylamide polymers, polyvinyl alcohol and its derivatives, polyvinyl acetals, polymers of alkyl and sulfoalkyl acrylates and methacrylates, hydrolyzed polyvinyl acetates, polyamides, polyvinyl pyridine, acrylic acid polymers, maleic anhydride copolymers, polyalkylene oxides, methacrylamide copolymers, polyvinyl oxazolidinones, maleic acid copolymers, vinylamine copolymers, methacrylic acid copolymers, acryloyloxyalkyl sulfonic acid copolymers, sulfoalkyl acrylamide copolymers, polyalkyleneimine copolymers, polyamines, N,N-dialkylaminoalkyl acrylates, vinyl imidazole copolymers, vinyl sulfide copolymers, halogenated styrene polymers, amineacrylamide polymers, polypeptides, compounds containing semicarbazone or alkoxy carbonyl hydrazone groups, polyester latex compositions, polystyryl amine polymers, vinyl benzoate polymers, carboxylic acid amide latices, copolymers containing acrylamidophenol cross-linking sites, vinyl pyrrolidone, colloidal silica and the like as described in Hollister et al U.S. Pat. Nos. 3,679,425, 3,706,564 and 3,813,251, Lowe U.S. Pat. Nos. 2,253,078, 2,276,322,'323, 2,281,703, 2,311,058 and 2,414,207, Lowe et al U.S. Pat. Nos. 2,484,456, 2,541,474 and 2,632,704, Perry et al U.S. Pat. No. 3,425,836, Smith et al U.S. Pat. Nos. 3,415,653 and 3,615,624, Smith U.S. Pat. No. 3,488,708, Whiteley et al U.S. Pat. Nos. 3,392,025 and 3,511,818, Fitzgerald U.S. Pat. Nos. 3,681,079, 3,721,565, 3,852,073, 3,861,918 and 3,925,083, Fitzgerald et al U.S. Pat. No. 3,879,205, Nottorf U.S. Pat. No. 3,142,568, Houck et al U.S. Pat. Nos. 3,062,674 and 3,220,844, Dann et al U.S. Pat. No. 2,882,161, Schupp U.S. Pat. No. 2,579,016, Weaver U.S. Pat. No. 2,829,053, Alles et al U.S. Pat. No. 2,698,240, Priest et al U.S. Pat. No. 3,003,879, Merrill et al U.S. Pat. No. 3,419,397, Stonham U.S. Pat. No. 3,284,207, Lohmer et al U.S. Pat. No. 3,167,430, Williams U.S. Pat. No. 2,957,767, Dawson et al U.S. Pat. No. 2,893,867, Smith et al U.S. Pat. Nos. 2,860,986 and 2,904,539, Ponticello et al U.S. Pat. Nos. 3,929,482 and 3,860,428, Ponticello U.S. Pat. No. 3,939,130, Dykstra U.S. Pat. No. 3,411,911 and Dykstra et al Canadian Patent 774,054, Ream et al U.S. Pat. No. 3,287,289, Smith U.K. Patent 1,466,600, Stevens U.K. Patent 1,062,116, Fordyce U.S. Pat. No. 2,211,323, Martinez U.S. Pat. No. 2,284,877, Watkins U.S. Pat. No. 2,420,455, Jones U.S. Pat. No. 2,533,166, Bolton U.S. Pat. No. 2,495,918, Graves U.S. Pat. No. 2,289,775, Yackel U.S. Pat. No. 2,565,418, Unruh et al U.S. Pat. Nos. 2,865,893 and 2,875,059, Rees et al U.S. Pat. No. 3,536,491, Broadhead et al U.K. Patent 1,348,815, Taylor et al U.S. Pat. No. 3,479,186, Merrill et al U.S. Pat. No. 3,520,857, Plakunov U.S. Pat. Nos. 3,589,908 and 3,591,379, Bacon et al U.S. Pat. No. 3,690,888, Bowman U.S. Pat. No. 3,748,143, Dickinson et al U.K. Patents 808,227 and '228, Wood U.K. Patent 822,192 and Iguchi et al U.K. Patent 1,398,055, DeWinter et al U.S. Pat. No. 4,215,196, Campbell et al U.S. Pat. No. 4,147,550, Sysak U.S. Pat. No. 4,391,903, Chen U.S. Pat. No. 4,401,787, Karino et al U.S. Pat. No. 4,396,698, Fitzgerald U.S. Pat. No. 4,315,071, Fitzgerald et al U.S. Pat. No. 4,350,759, Helling U.S. Pat. No. 4,513,080, Brück et al U.S. Pat. No. 4,301,240, Campbell et al U.S. Pat. No. 4,207,109, Chuang et al U.S. Pat. No. 4,145,221, Bergthaller et al U.S. Pat. No. 5 4,334,013, Helling U.S. Pat. No. 4,426,438, Anderson et al U.S. Pat. No. 5,366,855, Valentini U.S. Pat. No. 5,374,509, Ruger U.S. Pat. No. 5,407,792, Iwagaki et al EPO 0 131 161, and Bennett et al WO 94/13479 and WO 94/13481.

Many of the water soluble polymers useful as vehicles or vehicle components are themselves known to be effective in increasing covering power. These water soluble polymers are hereinafter referred to as category (a) covering power enhancers. Each of dextran, poly(vinyl alcohol), polyacrylamide, poly(ethylene glycol) and poly(vinyl pyrrolidone) are capable of increasing covering power when incorporated in emulsion layers employing gelatin or a gelatin derivative as a vehicle in a weight ratio of water soluble polymer to gelatino-vehicle of at least 0.1:1 to 1:1. A preferred weight ratio of water soluble polymer to gelatino-vehicle is the range of from 0.25:1 to 0.75:1.

Another class of covering power enhancing compounds that can be incorporated into the emulsion layers are those that adsorb to silver halide grain surfaces and contain at least one divalent sulfur atom, hereinafter also referred to as category (b) covering power enhancers. The divalent sulfur atom can take the form of a— S—or═S moiety. When the sulfur atom is present as a—S—moiety, it typically links two carbon atoms, two nitrogen trivalent nitrogen atoms, or a carbon atom and a trivalent nitrogen atom. When the sulfur atom is present as a ═S moiety, it forms a thioxocarbonyl (C═S) moiety. Most commonly the adsorbed covering power enhancer contains an azole or azine ring. The thioxocarbonyl and —S—can form a portion of the azole or azine ring. Additionally or alternatively the—S—moiety can be present as a ring substituent.

In one common form the adsorbed covering power enhancers are the 5-mercaptotetrazoles. In these compounds the 5-position divalent sulfur atom (—S—) can also, in one tautomeric form, rearrange to a thioxocarbonyl (C═S) moiety. As illustrated by U.K. Patent 1,004,302, 5-mercaptotetrazoles include the following representative compounds: 1-phenyl-5-mercaptotetrazole, 1(α-naphthyl)-5-mercaptotetrazole, 1-cyclohexyl-5-mercaptotetrazole, 1-methyl-5-mercaptotetrazole, 1-ethyl-5-mercaptotetrazole, 1-allyl-5-mercaptotetrazole, 1-isopropyl-5-mercaptotetrazole, 1-benzoyl-5-mercaptotetrazole, 1-p-chlorophenyl-5-mercaptotetrazole, 1-p-methylphenyl-5-mercaptotetrazole, 1-p-methoxycarbonylphenyl-5-mercaptotetrazole, and 1-p-diethylaminophenyl-5-mercaptotetrazole.

In another form covering power enhancing agents satisfying category (b) requirements are dithioxotriazoles of the type disclosed by U.K. Patent 1,237,541. These compounds are 1,3,5-triazoles with two of the three ring carbon atoms forming thioxocarbonyl (C═S) moieties. Representative examples of these compounds include: 1-phenyl-2,4-dithioxo-1,2,3,4-tetrahydro-1,3,5-triazine, 1-cyclohexyl-2,4-dithioxo-1,2,3,4-tetrahydro-1,3,5-triazine, 1-benzyl-2,4-dithioxo-1,2,3,4-tetrahydro-1,3,5-triazine, and 1-p-tolyl-2,4-dithioxo-1,2,3,4-tetrahydro-1,3,5-triazine.

In an additional form the overall ring structure is that of an indene or indan, but with at least one nitrogen atom located in the five or six membered ring and, often, both of these rings. The sulfur atom is attached to a ring carbon atom adjacent a ring nitrogen atom.

In this form U.K. Patent 1,257,750 discloses 4,6-dimercapto-1,2,5,7-tetraazaindenes to be useful covering power enhancing addenda satisfying category (b). Specifically disclosed compounds include 1-R-4,6-dimercapto-1,2,5,7-tetraazaindenes, where R is hydrogen, methyl, phenyl, pyrimidin-4-yl, 3-carboxyphenyl, 4-carboxyphenyl, or 2,4-diphenyl-1,3,5-triazin-6-yl.

Another preferred form of tetraazaindenes for satisfying component (b) requirements are 1,3,3a,7-and 1,3,3a,4-tetraazaindenes with a mercapto (—SH) or substituted mercapto (—SR) substituent, where R is preferably alkyl of from 1 to 11 carbon atoms. These compounds include: 2,6-dimethyl-4-mercapto-1,3,3a,7-tetraazaindene, 5-ethyl-7-mercapto-6-methyl-1,3,3a,4-tetraazaindene, 5-bromo-4-mercapto-6-methyl-1,3,3a,7-tetraazaindene, 4-hydroxy-2-mercapto-6-methyl-1,3,3a,7-tetraazaindene, and analogues of the compounds that contain a $C_1$–$C_{11}$, alkyl substituent replacing the mercapto hydrogen atom. These and other useful tetraazaindene compounds are disclosed by Landon U.S. Pat. No. 4,013,470, Rowland et al U.S. Pat. No. 4,728,601, and Adin U.S. Pat. No. 5,256,519, the disclosures of which are here incorporated by reference.

It is additionally contemplated to employ category (b) covering power enhancers of the type disclosed by Hershey U.S. Pat. No. 5,292,631, the disclosure of which are here incorporated by reference. These covering power enhancers contain as a common feature a 1,2,4-triazole ring contains a 5-position substituent satisfying the formula:

$$T—[S—(CH_2)_p—]_n—S—L_m—$$

wherein

L is a divalent linking group containing from 1 to 8 carbon atoms (e.g., from 1 to 8 methylene groups);

m is 0 or 1;

n is an integer of from 0 to 4;

p is an integer of from 2 to 4; and

T is an aliphatic moiety (e.g., alkyl) containing from 1 to 10 carbon atoms.

The 1,2,4-triazole ring can contain an additional 3-position nitrogen atom to form a tetrazole ring. Additionally the triazole ring can be fused with an azine ring to form a 1,3,3a,7-tetraazaindene ring structure.

In another preferred form the indene type compound can contain a 1 or 3 ring position trivalent nitrogen atom and a 2 ring position mercapto (or substituted mercapto, as described above) substituent. Illustrative compounds include: 2-mercaptobenzoxazole, 2-mercaptobenzothiazole, and 2-mercaptobenzimidazole. These compounds are illustrated by Landon U.S. Pat. No. 4,013,470, cited and incorporated by reference above. In its "M" series of compounds Landon illustrates still other mercapto-substituted azole and azine useful in the practice of this invention.

An azole ring compound that contains a thioxocarbonyl (C═S) ring member that cannot tautomerize to mercapto form can also be employed as a category (b) covering power enhancer. Compounds that contain a rhodanine ring are preferred. Other, comparable ring compounds having at least one similar thioxocarbonyl ring member include isorhodanine, 2- or 4-thiohydantoin, 2-thiooxazolidine-2,4-dione, and 2-thiobarbituric acid.

Each of these ring structures are common acidic nuclei of merocyanine dyes. Thus, it is specifically recognized that the category (b) covering power enhancer can, if desired, include the substituents necessary to complete a merocyanine dye chromophore. The following are illustrations of merocyanine dyes that can be used as category (b) covering power enhancers:

D-1 5-[(3-Ethyl-2[3H]-benzoxazolidene)ethylidene]-rhodanine;

D-2 5-p-Diethylaminobenzylidene-2-thiobarbituric acid;

D-3 3-Ethyl-5-[(3-ethyl-2[3H]-benzoxazolidene) ethylidene]rhodanine;

D-4 3-Ethyl-5-[(3-methyl-2[3H]-thiazolylidene) ethylidene] rhodanine;

D-5 3-Carboxymethyl-5-(3-methyl-2[3H]-benzothiazolidene)rhodanine;

D-6 3-Ethyl-5-[(3-ethyl-2[3H]-benzoxazolylidene)-ethylidene]-1-phenyl-2-thiohydantoin;

D-7 3-Ethyl-5-[(3-methyl-2[3H]-thiazolinylidene)-ethylidene]-2-thio-2,4-oxazolidinedione;

D-8 3-Ethyl-5-[(1-ethylnaphtho[1,2-d]thiazolin-2-ylidene)-1-methylthethylidene]rhodanine;

D-9 3-Ethyl-5-(3-piperidinoallylidene)rhodanine;

D-10 5-(3-Ethyl-2[3H]-benzoxazolylidene)-3-phenylrhodanine;

D-11 3-Ethyl-5-(1-ethyl-4[1H]-pyridylidene)rhodanine;

D-12 3-Ethyl-5-[(1-piperidyl)methylene]rhodanine;

D-13 3-Ethyl-5-[4-(3-ethyl-2-benzoselenazolinylidene)-2-butenylidene]-1-phenyl-2-thiohydantoin;

D-14 5-[(3-Ethyl-2[3H]-benzothiazolylidene)ethylidene-3-n-heptyl-1-phenyl-2-thiohydantoin;

D-15 5-[(3-Ethyl-2[3H]-benzothiazolylidene)ethylidene]-3-n-heptyl-1-phenyl-2-thio-2,4-dioxaxolidenedione;

D-16 5-[(1,3,3-Trimethyl-2-indolinylidene)ethylidene-rhodanine;

D-17 Bis[1,3-diethyl-2-thiobarbituric acid-(5)]-pentamethineoxonol;

D-18 5-[(3-Ethyl-2[3H]-benzoxazolylidene)ethylidene]-3-β-sulfoethyl-2-thio-2,4-oxazolidenedione;

D-19 3-Carboxymethyl-5-[(3-methyl-2[3H]-benzoxazolidene)ethylidene]rhodanine; and D-20 5-(3-Ethyl-2-benzothiazolinylidene)-3-β-sulfoethylrhodanine.

Generally any conventional covering power enhancing amount of the component (b) can be incorporated in the emulsion layers of the radiographic elements of the invention. Generally concentrations of component (b) ranging from 20 to 2000 mg/Ag mole are effective, with concentrations of from 30 to 700 mg/Ag mole being preferred.

While it is appreciated that higher absolute levels of covering power are realized with both category (a) and (b) covering power enhancers, the effect of obtaining increased levels of covering power and colder image tones is not dependent on their presence. Thus, the emulsion layers can contain neither, both or only one of category (a) or (b) covering power enhancers while realizing the benefits of the present invention. When the category (a) covering power enhancers polyacrylamide and/or dextran and category (b) covering power enhancers are both present in the emulsion layers, they additionally contribute to obtaining colder image tones.

The vehicle of the emulsion layers is hardened using one or more conventional forehardeners alone or in combination with one or more a prehardener, such as glutaraldehyde, incorporated in the developer used for processing. Conventional hardeners are illustrated by *Research Disclosure*, Item 38957, Section II.B. Hardeners and Dickerson U.S. Pat. No. 4,414,304, cited above and here incorporated by reference. From a comparison of Tables II and III of Dickerson '304, it is apparent that thin tabular grain emulsions show little reduction in covering power as a function of increased hardening, unlike nontabular and thicker tabular grain emulsions.

In addition to the two emulsion layers described above a radiographic element satisfying the requirements of the invention additionally includes blue tinted transparent film support BTTFS, which can be selected from among conventional blue tinted transparent radiographic film supports. Typically these supports consist of a transparent flexible film having subbing layers coated on opposite major faces to improve adhesion by hydrophilic colloids. In many instances the surface coating on the transparent film support is itself a hydrophilic colloid layer, but highly hardened so that it is not processing solution permeable. Radiographic film supports are blue tinted to contribute toward the cold image tones desired, whereas photographic film supports are rarely, if ever, blue tinted. The film support is usually constructed of polyesters to maximize dimensional integrity rather than employing cellulose acetate supports, as are most commonly employed in photographic elements. Radiographic film supports, including the incorporated blue dyes that contribute to cold image tones, are described in *Research Disclosure*, Vol. 184, April 1979, Item 18431, Section XII. *Research Disclosure*, Item 38957, Section XV. Supports, illustrates in paragraph (2) suitable subbing layers to facilitate adhesion of hydrophilic colloids to the support. Although the types of transparent films set out in Section XV, paragraphs (4), (7) and (9) are contemplated, due to their superior dimensional stability, the transparent films preferred are polyester films, illustrated in Section XV, paragraph (8). Poly(ethylene terephthalate) and poly (ethylene naphthalate) are specifically preferred polyester film supports.

While radiographic elements demonstrating the advantages of the invention can be constructed with the essential features described above, in most instances it is desired to optimize the imaging characteristics to serve a particular imaging application. The description that follows provides further details of radiographic element constructions that are preferred for serving typical medical diagnostic applications.

For medical diagnostic applications it is generally preferred that the radiographic element exhibit a sufficiently cold image tone to provide a b* value more negative than −5.0. To a large extent the blue dye incorporated in the transparent film support is relied upon for achieving desired b* values more negative than −5.0. To realize b* values more negative than −5.0, it is contemplated to place in the support blue dye in an amount sufficient to increase minimum density to at least 0.18. However, since elevated minimum density is not desired, the extent to which blue dye in the support must be relied upon to provide b* value more negative than −5.0 is preferably minimized and reliance on the features of the invention, preferably in combination with other image tone modifying addenda, are relied upon to achieve preferred b* values more negative than −5.0 and optimally more negative than −6.0.

It is preferred to employ the thinnest high bromide tabular grains compatible with achieving acceptable image tone. Covering power increases as the mean thickness of the tabular grains decreases. In dual-coated radiographic elements employing spectrally sensitized tabular grain emulsions, crossover is reduced as mean tabular grain thickness decreases. A general description of crossover in relation to dual-coated radiographic elements containing spectrally sensitized tabular grains is provided by Abbott et al U.S. Pat. Nos. 4,425,425 and 4,425,426, the disclosures of which are here incorporated by reference. While the invention is generally applicable to thin tabular grain emulsions and can be applied to even ultrathin tabular grain emulsions, for achieving b* values more negative than −5.0, it is preferred to employ tabular grains with mean thicknesses in the range of from 0.08 to about 0.15 $\mu$m.

When greater than 90 percent of total grains are accounted for by tabular grains, it is possible to realize a coefficient of variation (COV), based on total grain ECD's, of less than 20 percent, preferably less than 15 percent, and, optimally, less than 10 percent. In highly uniform grain emulsions tabular grains have been observed to account for substantially all (>97%) of total grain projected area. The patents of Tsaur et al and Fenton et al as well as Dickerson et al U.S. Pat. No. 5,252,442 in the HBTG patent listing above illustrate emulsions satisfying these more stringent COV and tabular grain projected area requirements. Reduced COV contributes to maintaining an average contrast of at least 2.7, which is typically preferred in medical diagnostic imaging.

It is generally preferred in medical diagnostic imaging that radiographic elements exhibit a maximum density of at least 3.0, with a maximum density of about 4.0 being optimum. Generally increasing maximum densities above 4.0 increases silver requirements without offering a significant diagnostic advantage.

To allow maximum density requirements to be satisfied with minimal silver coating coverages it is necessary to limit the forehardening of the gelatino-vehicle. Whereas it has become the typical practice to fully foreharden radiographic elements containing tabular grain emulsions, the radiographic elements of this invention are preferably only partially forehardened, with final hardening being accomplished by incorporating a prehardener in the developer, as was the standard practice prior to the teachings of Dickerson U.S. Pat. No. 4,414,304.

The degree of forehardening is quantified by reference to the following standard rapid access processing cycle:

development 24 seconds at 40° C.
fixing 20 seconds at 40° C.,
washing 10 seconds at 40° C,
drying 20 seconds at 65° C.

To realize an acceptable maximum density at a minimal silver coating coverage, hardening is limited to allow a weight gain of greater than 200 percent (preferably at least 220 percent), based on total weight of the gelatino-vehicle, by the end of the washing step, where the development step is employed using a developer that exhibits the composition:

hydroquinone 30 g
4-hydroxymethyl-4-methyl-1-phenyl-3-pyrazolidinone 1.5 g
KOH 21 g
$NaHCO_3$ 7.5 g
$K_2SO_3$ 44.2 g
$Na_2S_2O_5$ 12.6 g
5-methylbenzotriazole 0.06 g
glutaraldehyde 4.9 g
water to 1 liter (pH=10).

This test establishes the maximum amount of forehardening contemplated in the radiographic elements of the invention. The minimum amount of forehardening is established by the requirement that the radiographic element emerge dry by the end of the drying step. That is, the radiographic element must be capable of being dried within 20 seconds when heated to 65° C. following washing step. This level of forehardening is sufficient to allow the radiographic element to be acceptably handled and processed. A more detailed description of the processing cycle, including the composition used in each step, is provided by Dickerson et al U.S. Pat. No. 4,900,652, the disclosure of which is here incorporated by reference.

It is recognized that the processing cycle described above is a reference for quantifying forehardening. In actual use, different processing cycles and developing solutions can be used.

It is preferred that the emulsion layers contain one or more addenda to minimize fog. Conventional addenda of this type are disclosed in *Research Disclosure*, Item 38957, Section VII. Antifoggants and stabilizers, in the patents forming the HBTG listing above.

Although the radiographic elements have been described in terms of a simple construction consisting of a single emulsion layer coated on opposite sides of the blue tinted transparent film support BTTFS, it is appreciated that the emulsion layer can be replaced by emulsion layer unit ELU containing two or more separate emulsion layers. Also, it is usually advantageous to coat a protective layer unit PLU, which is commonly comprised of a surface overcoat SOC and an interlayer IL. It is also common practice to include an underlying layer unit ULU. An illustrative dual-coated radiographic element containing each of these features is shown below:

| |
|---|
| SOC |
| IL |
| ELU |
| ULU |
| BTTFS |
| ULU |
| ELU |
| IL |
| SOC |

Since only a single emulsion layer on each side of the support is required, it is appreciated that any one or combination of ULU, IL and SOC can be omitted.

The vehicles, including hardening, of each of the layers coated on the support are selected to satisfy the description provided above pertaining to the emulsion layer. The total hydrophilic colloid on each side of the support is preferably limited to less than 35 mg/dm$^2$.

The underlying layer unit ULU provides a convenient location for processing solution decolorizable microcrystalline dyes that are optionally, but commonly used to reduce crossover in dual-coated radiographic elements. Preferred processing solution decolorizable microcrystalline dyes are disclosed by Dickerson et al U.S. Pat. Nos. 4,803,150 and 4,900,652 and Diehl et al U.S. Pat. No. 4,940,654, the disclosures of which are here incorporated by reference.

A preferred radiographic element construction is to place the microcrystalline dye in an emulsion layer coated nearest the support which is overcoated with a second, faster emulsion layer. Constructions of this type are disclosed in Dickerson et al U.S. Pat. No. 5,576,156, the disclosure of which is here incorporated by reference.

The protecting layer unit PLU acts to physically protect the emulsion layer unit ELU and also provides a preferred location for a variety of conventional physical property modifying addenda. A more general description of PLU constructions and their components is provided by *Research Disclosure*, Item 18431, cited above, III. Antistatic Agents/Layers and IV. Overcoat Layers, and *Research Disclosure*, Item 38957, cited above, IX. Coating physical property modifying addenda, A. Coating aids, B. Plasticizers and lubricants, C. Antistats, and D. Matting agents. It is common practice to divide PLU into a surface overcoat and an interlayer. The interlayers are typically thin hydrophilic colloid layers that provide a separation between the emulsion and the surface overcoat addenda. It is quite common to locate surface overcoat addenda, particularly antimatte particles, in the interlayer.

EXAMPLES

The invention can be better appreciated by reference to the following specific embodiments. All coating coverages are in units of mg/dm2, except as otherwise indicated. Grain coverages are based on the weight of silver. The suffixes (c) and (ex) are employed to identify comparative and example elements, respectively.

Element A(c)

A radiographic element was constructed by coating onto both major faces a blue tinted 7 mil (178 μm) poly(ethylene terephthalate) film support (S) having a neutral density of 0.18 an emulsion layer (EL), an interlayer (IL) and a transparent surface overcoat (SOC), as indicated:

| |
|---|
| SOC |
| IL |
| EL |
| S |
| EL |
| SOC |

| Contents | Coverage |
|---|---|
| Emulsion Layer (EL) | |
| Ag | 9.4 |
| Gelatin | 20.4 |
| 4-Hydroxy-6-methyl-1,3,3a,7-tetraazaindene | 2.1 g/Ag mole |
| Potassium nitrate | 1.8 |
| Ammonium hexachloropalladate | 0.0022 |
| Maleic acid hydrazide | 0.0087 |
| Sorbitol | 0.53 |
| Glycerin | 0.57 |
| Potassium Bromide | 0.14 |
| Resorcinol | 0.44 |
| Bis(vinylsulfonylmethyl)ether (based on wt. of gelatin in all layers) | 2.4% |
| Interlayer (IL) | |
| Gelatin | 3.4 |
| AgI Lippmann | 0.11 |
| Carboxymethyl casein | 0.57 |
| Colloidal silica | 0.57 |
| Polyacrylamide | 0.57 |
| Chrome alum | 0.025 |
| Resorcinol | 0.058 |
| Nitron | 0.044 |
| Surface Overcoat (SOC) | |
| Gelatin | 3.4 |
| Poly(methyl methacrylate) matte beads | 0.14 |
| Carboxymethyl casein | 0.57 |
| Colloidal silica | 0.57 |
| Polyacrylamide | 0.57 |
| Chrome alum | 0.025 |
| Resorcinol | 0.058 |
| Whale oil lubricant | 0.15 |

The Ag in EL was provided in the form a thin, high aspect ratio tabular grain silver bromide emulsion in which the tabular grains accounted for greater than 90 percent of total grain projected area, exhibited an average equivalent circular diameter (ECD) of 1.8 μm, an average thickness of 0.13 μm. The grains exhibited a COV of 30 percent. The tabular grain emulsion was sulfur and gold sensitized and spectrally sensitized with 400 mg/Ag mole of anhydro-5,5-dichloro-9-ethyl-3,3'-bis(3-sulfopropyl)oxacarbocyanine hydroxide, sodium salt, followed by the addition of 300 mg/Ag mole of KI. The AgI Lippmann emulsion present in IL exhibited a mean ECD of 0.08 $\mu$m.

Element B(c)

This element constructed identically to Element A(c), except that the emulsion layer was constructed as follows:

| Emulsion Layer (EL) | |
|---|---|
| Contents | Coverage |
| Ag | 9.4 |
| Gelatin | 20.4 |
| 4-Hydroxy-6-methyl-1,3,3a,7-tetraazaindene | 2.1 g/Ag mole |
| 4-Hydroxy-6-methyl-2-methylmercapto-1,3,3A,7-tetraazaindene | 400 mg/Ag mole |
| 2-Mercapto-1,3-benzothiazole | 30 mg/Ag mole |
| Potassium nitrate | 1.8 |
| Ammonium hexachloropalladate | 0.0022 |
| Maleic acid hydrazide | 0.0087 |
| Sorbitol | 0.53 |
| Glycerin | 0.57 |
| Potassium Bromide | 0.14 |
| Resorcinol | 0.44 |
| Dextran | 5.38 |
| Polyacrylamide | 2.69 |
| Carboxymethyl casein | 1.61 |
| Bis(vinylsulfonylmethyl)ether (based on wt. of gelatin in all layers) | 2.4% |

Because of the slightly higher average aspect ratio of the grains, a slightly higher amount of the spectral sensitizing dye, 590 mg/Ag mole, was required for optimum sensitization.

Element C(c)

This element was similar to Element B, except that hardener was reduced from 2.4 to 1.6 percent by weight.

Element D(c)

This element was similar to Element B, except that hardener was reduced from 2.4 to 0.8 percent by weight.

Element E(c)

This element was similar to Element B, except that hardener was reduced from 2.4 to 0.4 percent by weight.

Element F(ex)

This element was similar to Element E, except that the hydrophilic colloid coverages in each emulsion layer were reduced as follows:
Gelatin 16.1
Dextran 3.5
Polyacrylamide 1.7
Carboxymethyl casein 1.1

Element G(ex)

This element was similar to Element E, except that the hydrophilic colloid coverages in each emulsion layer were reduced as follows:
Gelatin 11.8
Dextran 2.7
Polyacrylamide 1.3
Carboxymethyl casein 0.78

Element H(ex)

This element was similar to Element E, except that the hydrophilic colloid coverages in each emulsion layer were reduced as follows:
Gelatin 7.5
Dextran 2.2
Polyacrylamide 0.8
Carboxymethyl casein 0.48

Sensitometry

Each of Elements A thru E were mounted between a pair of Lanex™ regular intensifying screens and exposed to 70 KVp X-radiation using a 3-phase Picker Medical (Model VTX-650)™ exposure unit containing filtration of up to 3 mm of Al. Sensitometric gradations in exposure were achieved by using a 21 increment (0.1 log E, where E represents exposure in lux-seconds) Al step wedge of varying thickness.

The exposed elements were processed using a Kodak X-Omat™ M6A-N film processor set for a 90 seconds processing cycle:
Development 24 seconds at 40° C.
Fixing 20 seconds at 40° C.
Washing 10 seconds at 40° C.
Drying 20 seconds at 65° C.
where the time not otherwise accounted for was taken up in transport between stages.

The composition of the developer was as follows:
Hydroquinone 30 g
4-Hydroxymethyl-4-methyl-1-phenyl-3-pyrazolidinone 1.5 g
KOH 21 g
$NaHCO_3$ 7.5 g
$K_2SO_3$ 44.2 g
$Na_2S_2O_5$ 12.6 g
5-Methylbenzotriazole 0.06 g
Glutaraldehyde 4.9 g
Water to 1 Liter (pH=10)

Optical densities are expressed in terms of diffuse density as measured by an X-rite Model 310TM densitometer, which was calibrated to ANSI standard PH 2.19 and was traceable to a National Bureau of Standards calibration step tablet. The characteristic curve (density vs. log E) was plotted for each radiographic element processed. Speed was measured at a density of 1.00 above minimum density and is reported in relative log units, where each unit of speed difference is equal to 0.01 log E, where E is exposure in lux-seconds. The upper density point UDP was the highest density measured in the film sample exposed.

Speed (SPD), contrast (y), and upper density point (UDP) are reported in Table I.

TABLE I

| Element | SPD | γ | UDP |
|---|---|---|---|
| A(c) | 450 | 2.6 | 3.1 |
| B(c) | 441 | 1.4 | 2.2 |
| C(c) | 443 | 2.0 | 2.2 |
| D(c) | 446 | 2.2 | 2.3 |
| E(c) | 443 | 2.8 | 2.57 |
| F(ex) | 451 | 2.7 | 2.65 |
| G(ex) | 451 | 2.7 | 2.72 |
| H(ex) | 454 | 2.9 | 3.0 |

From Table I it is apparent that the radiographic elements of the invention (F–H) exhibited speed and contrast characteristics that were superior to those of Element A(c). The upper density point was just slightly less than that of A(c), but reached the preferred maximum of 3.0.

Speed, contrast and upper density point measurements for radiographic elements F–H were superior to those for comparison radiographic elements B–E that contained exactly the same addenda, but higher hydrophilic colloid coverages and, in some instances, higher levels of hardening.

Practical covering power (PCP) was determined as described in the definition of covering power above, except that the highest density obtained in the film sample was substituted for maximum density. Where sample exposure did not reach maximum density, this provided a value less than covering power, but it better correlates with performance that can be expected in use under the exposure and processing conditions here chosen.

Image tone was measured in terms of b* values as described in the definitions above.

Image tone b* and practical covering power PCP characteristics observed are reported in Table II and correlated with hydrophilic colloid coating coverage in each emulsion layer (HC/S), silver coating coverage in each emulsion layer (Ag/S), and hardener level (H) reported in terms of weight percent, based on total hydrophilic colloid.

TABLE II

| Element | HC/S | Ag/S | H | PCP | b* |
|---|---|---|---|---|---|
| A(c) | 31.2 | 18.3 | 2.4 | 8.0 | −6.0 |
| B(c) | 30.1 | 9.35 | 2.4 | 11.6 | −5.7 |
| C(c) | 30.1 | 9.35 | 1.6 | 11.6 | 5.7 |
| D(c) | 30.1 | 9.35 | 0.8 | 11.9 | 5.5 |
| E(c) | 30.1 | 9.35 | 0.4 | 12.8 | −5.5 |
| F(ex) | 22.4 | 9.35 | 0.4 | 14.6 | −5.6 |
| G(ex) | 16.6 | 9.35 | 0.4 | 15.1 | −5.9 |
| H(ex) | 11.0 | 9.35 | 0.4 | 17.0 | −6.1 |

It is apparent that the radiographic elements F-H satisfying the requirements of the invention exhibited superior practical covering power characteristics. At hydrophilic colloid coating coverages of less than 15 mg/dm2, element H, b* values were more negative than those of any other element. Note, that although comparison element A exhibited speed, contrast and upper density point characteristics that compared favorably to elements F–H in Table I, the covering power of element A was markedly inferior.

From elements F, G and H it is apparent that lowering hydrophilic colloid coating coverages below 30 mg/dm$^2$ improved by covering power and image tone.

Hardener Level

Although hardener levels are reported above in terms of weight percent hardener, based on the weight of the gelatino-vehicle, it is appreciated that these levels are dependent on the specific choice of hardener.

To translate the degree of hardening into a general hardening level that is independent of the specific hardener chosen, the rapid access processor was stopped as a sample of each radiographic element began to emerge from the dryer. By opening the drying section of the processor with the film in place it was possible to observe what percentage of the total drying step was required to fully dry the radiographic element.

To provide still another, more generally applicable parameter for comparing hardening, samples of the film were weighed as they left the washing stage of the processor and before they reached the dryer. This provided a measure of the percent weight gain, based on the weight of gelatino-vehicle present in the element before processing. This measurement allows the degree of hardening to be compared in elements containing widely differing gelatino-vehicle coating coverages.

The results are summarized in Table III.

TABLE III

| Hardener (wt %) | Drying Time (sec) | Weight Gain % |
|---|---|---|
| 2.4 | 4 | 182 |
| 0.4 | 13 | 276 |

From Table III it is apparent that when the weight percent hardener was dropped to 0.4 weight percent, based on the total weight of hydrophilic colloid, weight gain was measured to be well above 200 percent. The additional water pick up was well within the drying capacity of the rapid access processor.

Dye Stain

Residual dye stain was measured using spectrophotometric methods and calculated as the difference between density at 505 nm, which corresponds to the dye absorption peak, and the density at 440 nm, which outside the spectral region of dye absorption and within the spectral absorption region of developed silver. Measurements were performed on film samples that were processed, but not exposed. Thus, the only silver density present was attributable to fog. By taking the difference in densities, fog was eliminated from the dye stain measurements.

Observed dye stain is reported in Table IV as a function of hydrophilic colloid and silver coating coverages.

TABLE IV

| Element | HC/S | Ag/S | Dye Stain |
|---|---|---|---|
| A(c) | 31.2 | 18.3 | 0.054 |
| B(c) | 30.1 | 9.35 | 0.034 |
| C(c) | 30.1 | 9.35 | 0.031 |
| D(c) | 30.1 | 9.35 | 0.031 |
| E(c) | 30.1 | 9.35 | 0.025 |
| F(ex) | 22.4 | 9.35 | 0.017 |
| G(ex) | 16.6 | 9.35 | 0.012 |
| H(ex) | 11.0 | 9.35 | 0.009 |

From Table IV it is apparent that the lowest observed levels of dye stain were realized with the radiographic elements satisfying the requirements of the invention.

The invention has been described in detail with particular reference to preferred embodiments thereof, but it will be understood that variations and modifications can be effected within the spirit and scope of the invention.

What is claimed is:

1. A radiographic element comprised of a blue tinted film support having first and second major surfaces and, coated on each of the major surfaces of the support, at least one tabular grain emulsion layer containing a hydrophilic colloid vehicle and radiation-sensitive silver halide grains containing greater than 50 mole percent bromide and less than 3 mole percent iodide, based on silver, the weight ratio of silver forming the silver halide grains to the hydrophilic colloid being less than 1:1, WHEREIN, within the tabular grain emulsion layer, the tabular grains have a mean thickness of less than 0.2 μm and the hydrophilic colloid is coated at a coverage of less than 15 $mg/dm^2$.

2. A radiographic element according to claim 1 wherein the hydrophilic colloid is coated at a coverage of at least 5 $mg/dm^2$.

3. A radiographic element according to claim 1 wherein the tabular grains have a mean in thickness in the range of from 0.08 to 0.15 μm.

4. A radiographic element according to claim 1 wherein hardening of the hydrophilic colloid is chosen to allow a weight gain of greater than 200 percent, based on the total weight of gelatino-vehicle, after the following process cycle:

development 24 seconds at 40° C.

fixing 20 seconds at 40° C., washing 10 seconds at 40° C., when the developer exhibits the composition:

hydroquinone 30 g 4-hydroxymethyl-4-methyl-1-phenyl-3-pyrazolidinone 1.5 g

KOH 21 g $NaHCO_3$ 7.5 g $K_2SO_3$ 44.2 g $Na_2S_2O_5$ 12.6 g 5-methylbenzotriazole 0.06 g glutaraldehyde 4.9 g water to 1 liter (pH=10)

while allowing subsequent drying at 65° C. within 20 seconds.

5. A radiographic element according to claim 1 wherein the element exhibits a b* value more negative than −5.0.

6. A radiographic element according to claim 1 wherein blue dye in the support increases the neutral density of the support to at least 0. 18.

* * * * *